US011162275B2

(12) United States Patent
Heschel

(10) Patent No.: US 11,162,275 B2
(45) Date of Patent: Nov. 2, 2021

(54) ADJUSTABLE FOOTING FOR A POST

(71) Applicant: Geoffrey Arthur Heschel, Morse (CA)

(72) Inventor: Geoffrey Arthur Heschel, Morse (CA)

( * ) Notice: Subject to any disclaimer, the term of this patent is extended or adjusted under 35 U.S.C. 154(b) by 0 days.

(21) Appl. No.: 15/582,536

(22) Filed: Apr. 28, 2017

(65) Prior Publication Data

US 2018/0313095 A1 Nov. 1, 2018

(51) Int. Cl.

| | |
|---|---|
| ***E04F 15/02*** | (2006.01) |
| ***E04H 12/22*** | (2006.01) |
| ***A47B 91/02*** | (2006.01) |
| ***E04H 17/22*** | (2006.01) |

(52) U.S. Cl.

CPC ..... *E04H 17/22* (2013.01); *A47B 91/02* (2013.01); *A47B 91/022* (2013.01); *A47B 91/024* (2013.01); *E04F 15/02044* (2013.01); *E04F 15/02183* (2013.01); *E04H 12/2238* (2013.01); *E04H 12/2253* (2013.01); *E04H 12/2261* (2013.01); *E04H 12/2276* (2013.01); *E04F 2015/02061* (2013.01)

(58) Field of Classification Search

CPC ..... E04F 15/0247; E04F 15/02183; E04F 21/1877; E04H 17/22; E04H 12/2284; E04H 12/2238; E04H 12/2253; E04H 12/2261; E04H 12/2269; E04B 2002/749; E04D 11/007; E04C 3/005; E02D 27/42; A47B 91/02; A47B 91/022; A47B 91/024; A47B 91/026

USPC ..... 52/126.6, 263, DIG. 11; 248/405, 161, 248/188.2, 188.4

See application file for complete search history.

(56) References Cited

U.S. PATENT DOCUMENTS 144,028 A * 10/1873 Luarde ..... A47B 91/024 248/188.4
1,886,112 A * 11/1932 Luarde ..... A47B 91/04 248/188.4
2,024,728 A * 12/1935 Galson ..... F16F 1/3814 16/19

(Continued)

FOREIGN PATENT DOCUMENTS

CH 174592 A * 1/1935 ..... A47B 91/024
DE 2311462 A1 * 9/1974 ..... A47B 91/024

(Continued)

OTHER PUBLICATIONS

Derwent 2019-23819T, Abstract for KR 2019021882 A, Mar. 2019 (Year: 2019).*

(Continued)

*Primary Examiner* — Robert Canfield
(74) *Attorney, Agent, or Firm* — Orin Del Vecchio

(57) ABSTRACT

According to an embodiment of the invention, there is provided an adjustable footing for a post, the adjustable footing comprising: a base, the base comprising a base plate, a fixed base nut secured to the base plate and a threaded rod secured to the base nut and extending perpendicular to the base; and a top, the top comprising a post plate having a hole and a fixed post nut secured to the post plate over the hole and dimensioned to engage the threaded rod. The post plate is secured to the post such that the threaded rod passes through the post nut and hole into a cavity in the post, and the overall height of the footing is adjustable by rotation of the base via the base nut.

11 Claims, 3 Drawing Sheets

(56) References Cited

U.S. PATENT DOCUMENTS 2,327,050 A * 8/1943 Kotler ..... A47B 91/024 248/188.4
2,890,545 A * 6/1959 Fiddler ..... A47B 91/024 16/42 R
3,195,968 A * 7/1965 Freeman ..... A47B 47/042 217/65
3,288,418 A * 11/1966 Hinrichs ..... E04B 2/824 52/632
3,565,501 A * 2/1971 Bowen et al. ..... A47B 91/024 248/188.4
4,603,530 A * 8/1986 Glockenstein ..... E04B 2/82 52/126.6
4,752,056 A * 6/1988 Culbertson ..... A47B 91/12 248/188.9
5,203,039 A * 4/1993 Fredman ..... A47C 19/024 248/188.4
5,666,774 A * 9/1997 Commins ..... E04H 12/2253 248/188.4
6,256,939 B1 * 7/2001 Snyder ..... E04D 11/007 248/354.3
6,520,459 B2 * 2/2003 Burr ..... A47B 91/066 248/188.2
7,134,154 B2 * 11/2006 Cloer ..... A47C 19/024 5/201
7,287,732 B2 * 10/2007 Balistreri ..... A47L 15/4253 248/188.4
9,752,331 B2 * 9/2017 Kugler ..... E04F 15/0247
9,803,377 B2 * 10/2017 Pelc, Jr. ..... E04B 1/003
9,976,298 B2 * 5/2018 Bergman ..... E04B 1/486
10,610,009 B1 * 4/2020 Ciputra ..... A47B 13/003
2006/0283434 A1 * 12/2006 Johnson ..... E04C 3/005 124/74
2008/0304919 A1 * 12/2008 Coyle ..... E02D 27/02 405/250
2012/0324821 A1 * 12/2012 Kordecki ..... E04G 21/243 52/708
2013/0313385 A1 * 11/2013 Mora ..... F16M 7/00 248/188.4
2013/0313386 A1 * 11/2013 Adams ..... F24C 15/086 248/188.4
2017/0067262 A1 * 3/2017 Kugler ..... E04F 15/0247
2017/0350141 A1 * 12/2017 Kugler ..... E04F 15/0247

FOREIGN PATENT DOCUMENTS

DE 2511540 A1 * 11/1977 ..... A47B 53/00
DE 3035501 A1 * 5/1982 ..... A47B 57/34
DE 3518933 A1 * 11/1986 ..... A47B 91/028
DE 9303442 U1 * 8/1993 ..... A47B 91/024
DE 4317814 A1 * 12/1994 ..... E04F 15/02405
DE 202014008319 U1 * 1/2016 ..... A47B 91/024
EP 313486 A1 * 4/1989
EP 0722681 A2 * 7/1996 ..... A47B 91/028
FR 472412 A * 12/1914 ..... A47B 91/024
FR 476181 A * 7/1915 ..... A47B 91/022
FR 555458 A * 6/1923 ..... A47B 91/024
GB 136348 A * 12/1919 ..... A47B 91/024
GB 2399382 A * 9/2004

OTHER PUBLICATIONS 8 page PDF pf machine translation of DE 2311462-A1. (Year: 1974).*
7 page PDF of machine translation of EP 313486-A1. (Year: 1989).*
7 page PDF of machine translation of FR 476181-A. (Year: 1915).*

* cited by examiner

ADJUSTABLE FOOTING FOR A POST

FIELD OF THE INVENTION

The present specification relates generally to posts for decks and similar structures, and in particular to footing for a post which is adjustable in place to modifying the height of the post.

BACKGROUND OF THE INVENTION

Installation of a floating deck requires numerous deck posts to support the structure and balance the load of the deck. One of the challenges of construction is ensuring that the deck posts are positioned and height-adjusted to ensure that the deck surface is level and balanced.

However, over time, due to issues such as soil settling and deck material warping, particularly in areas with high water tables, the deck posts may no longer maintain their original position and structures. As a consequence, the deck surface may no longer be level, and may even be subject to damage.

Thus, there is a demand for a deck post which may be height-adjusted during construction as well as after construction, to account for changes over time.

Accordingly, there remains a need for improvements in the art.

SUMMARY OF THE INVENTION

In accordance with an aspect of the invention, there is provided an adjustable footing for a post.

According to an embodiment of the invention, there is provided an adjustable footing for a post, the adjustable footing comprising: a base, the base comprising a base plate, a fixed base nut secured to the base plate and a threaded rod secured to the base nut and extending perpendicular to the base; and a top, the top comprising a post plate having a hole and a fixed post nut secured to the post plate over the hole and dimensioned to engage the threaded rod. The post plate is secured to the post such that the threaded rod passes through the post nut and hole into a cavity in the post, and the overall height of the footing is adjustable by rotation of the base via the base nut.

According to another embodiment of the invention, there is provided an adjustable deck post, the deck post having a cavity in a bottom surface, the cavity extending perpendicular from the bottom surface along a longitudinal axis of the deck post, a base, the base comprising a base plate, a fixed base nut secured to the base plate and a threaded rod secured to the base nut and extending perpendicular to the base, and a top, the top comprising a post plate having a hole and a fixed post nut secured to the post plate over the hole and dimensioned to engage the threaded rod. The post plate is secured to the deck post such that the threaded rod passes through the post nut and hole into the cavity in the post, and the overall height of the footing is adjustable by rotation of the base via the base nut.

According to another embodiment of the invention, there is provided a method of securing an adjustable footing to a deck post, the method comprising: boring a cavity into a bottom surface of the deck post, the cavity extending along a longitudinal axis of the deck post; securing a post plate to the bottom surface, the post plate having a hole aligned with the cavity and a post nut secured to the post plate and covering the hole; and connecting a base plate to the post plate by a threaded rod, the threaded rod extending perpendicular to the base plate and secured to the base plate by a fixed base nut. The threaded rod extends into the cavity; and the post plate, post nut, threaded rod, base nut and base plate form the adjustable footing for the deck post Other aspects and features according to the present application will become apparent to those ordinarily skilled in the art upon review of the following description of embodiments of the invention in conjunction with the accompanying figures.

BRIEF DESCRIPTION OF THE DRAWINGS

Reference will now be made to the accompanying drawings which show, by way of example only, embodiments of the invention, and how they may be carried into effect, and in which.

Like reference numerals indicated like or corresponding elements in the drawings.

DETAILED DESCRIPTION OF THE EMBODIMENTS

The present invention relates to posts for decks and the like, and in particular, to an adjustable footing for a deck post. In the context of the embodiments herein a deck post is a post which provides support for a structure such as a floating deck, however, similar posts may be used for other structures such as stairs or fences, and would be understood to be equivalent to a deck post as described herein.

Figure 1:
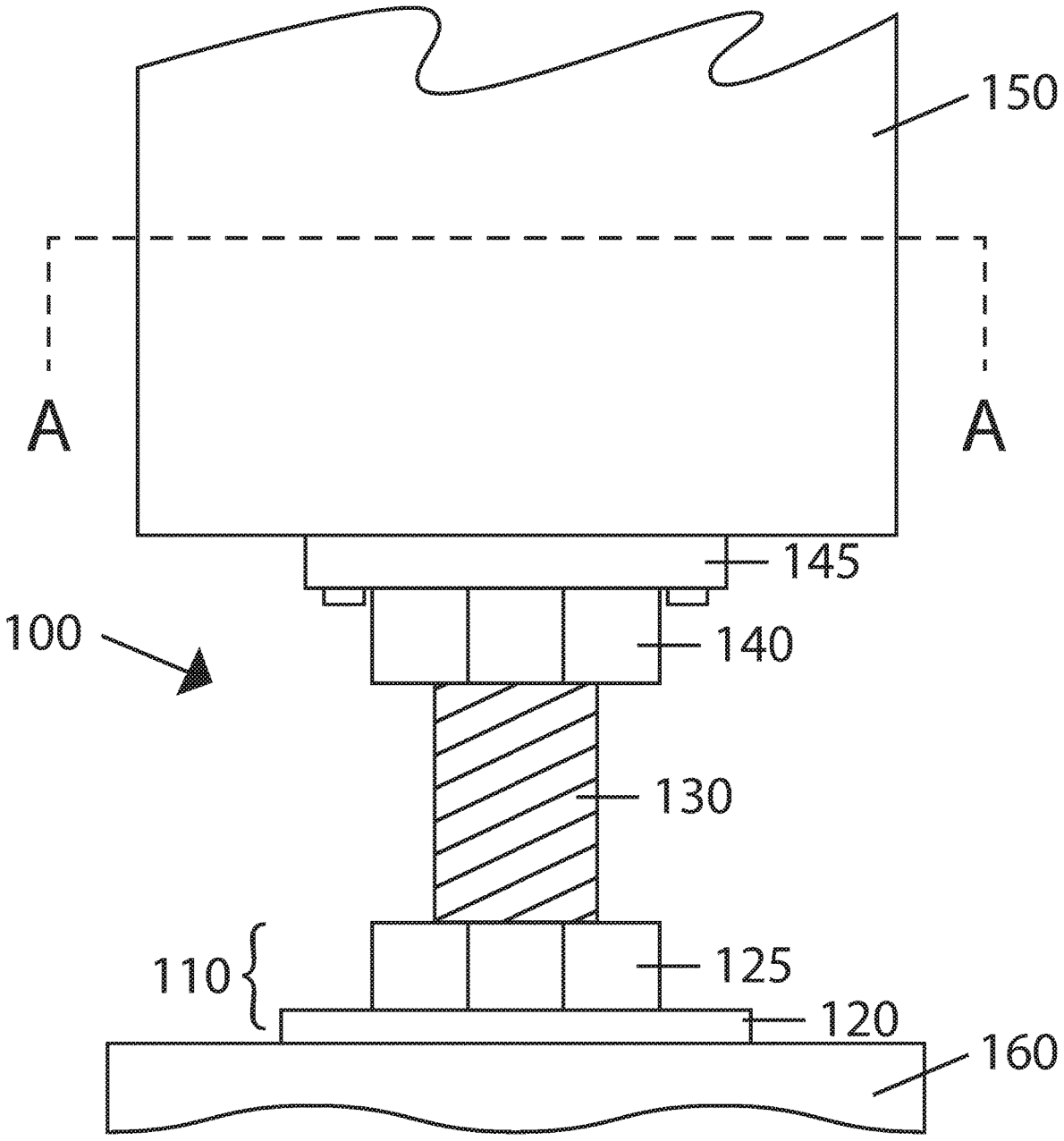
FIG. 1 is a front view of a deck post and adjustable footing according to an embodiment.

According to an embodiment as shown in FIG. 1, a deck post footing 100 may comprise a base 110 with a base plate 120 and a threaded extension rod 130 extending perpendicular to the base plate and secured to base plate 120 by a fixed base nut 125. Base nut 125 is secured to base plate 120 by welding (for metal) or a permanent adhesive. Alternatively, extension rod 130 by be directly secured to base plate 120 by similar methods. Base nut 125 and extension rod 130 may also be combined into a single bolt which may be welded or otherwise secured to base plate 120.

The threaded extension rod 130 is threaded through a top formed from a post plate 145 with a hole covered by a post nut 140 which is secured to post plate 145 similarly to base plate 120 and base nut 125. Post plate 145 is secured to the bottom of a deck post 150 by screws 165 (e.g. #8 deck screws), nails or equivalent fasteners. Alternatively, plate 145 may be secured by a permanent adhesive, or welded, for a metal deck post.

Figure 2:
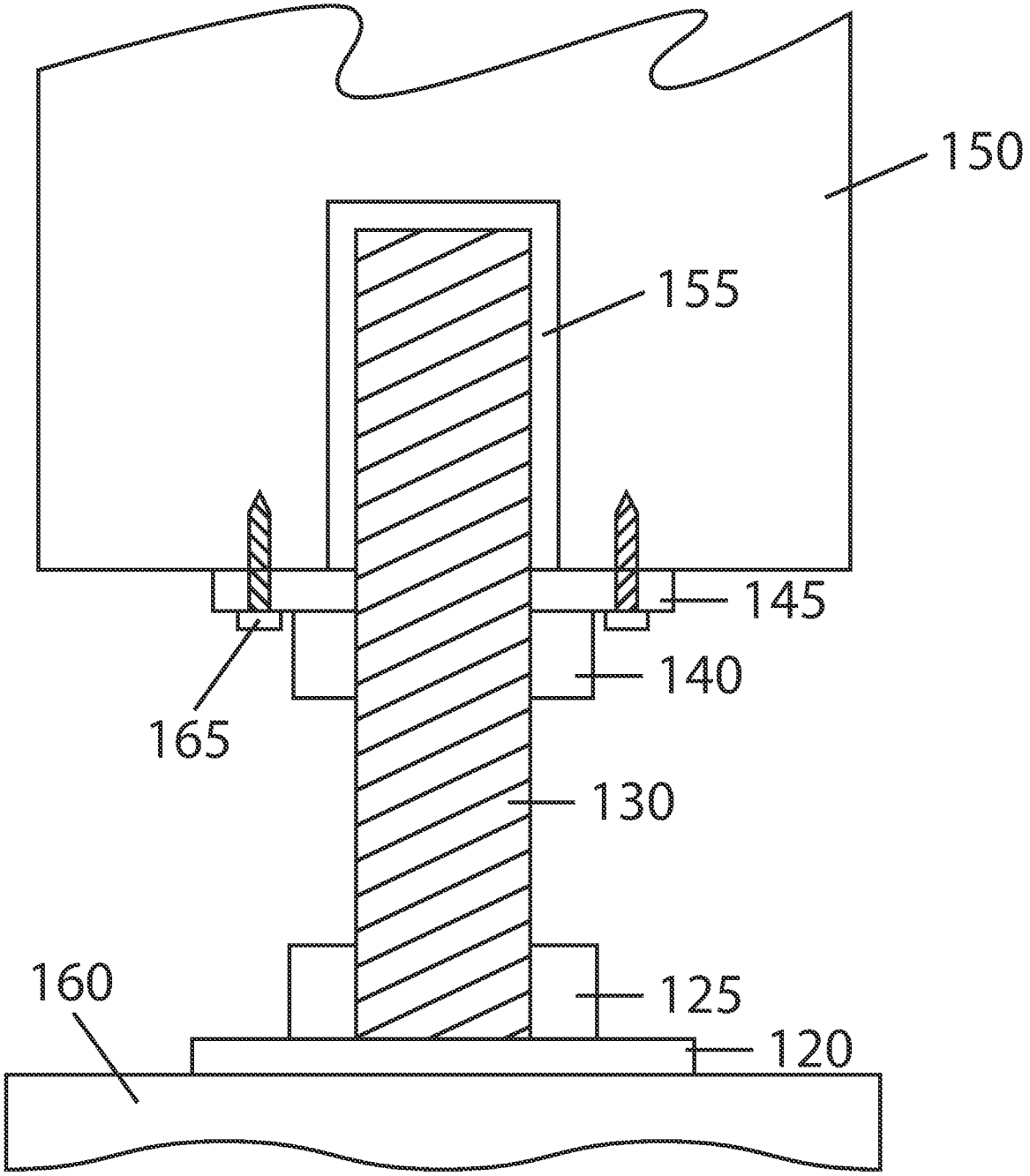
FIG. 2 is a cut-away view of FIG. 1 along line A-A.
Figure 3:
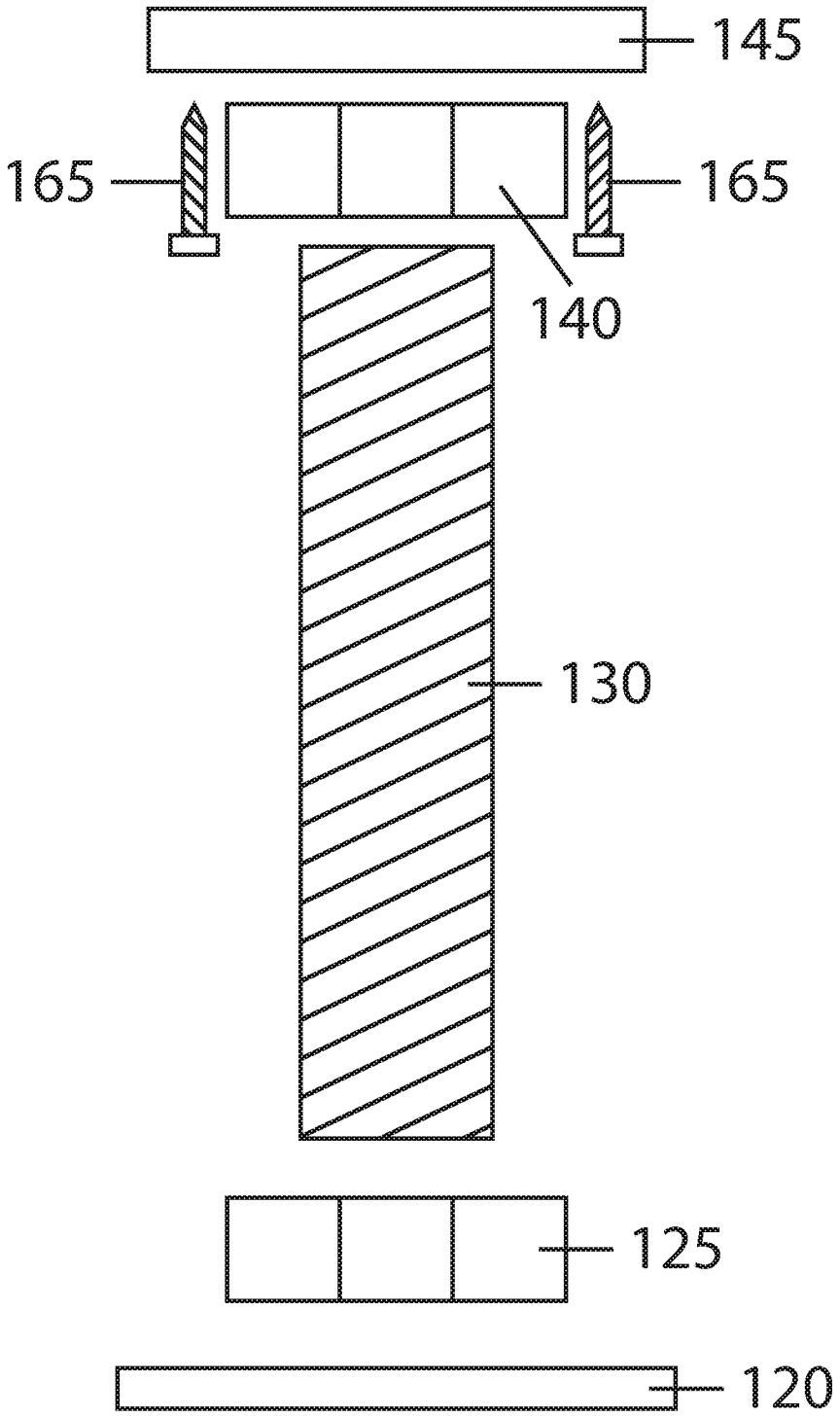
FIG. 3 is an exploded view of the adjustable footing of FIG. 1.

Extension rod 130 thus extends through the hole in post plate 145 and post nut 140 into a cavity 155 (as shown in FIG. 2) inside deck post 150 which is dimensioned to permit the extension rod 130 to both fit within the cavity, as well as to be extended vertically to adjust the overall height of the deck post 150 via rotation of the base 110 via the base nut 125.

In operation, base plate 120 rests upon a concrete slab 160 or patio stone to support the weight of deck post 150 and the deck (not shown) which it supports. Base plate 120 is not secured to the slab 160 in order to permit rotation of base 110 to adjust the height of the footing 100 and deck post 150. To further facilitate rotation, an anti-seize compound may be apply to extension rod 130 and/or post nut 140 prior to assembly.

The height of the deck post 150 may be adjusted by adjusting the height of base 110 via the rotation of base nut 125 using a wrench or even by hand, depending on the amount of weight supported by the footing 100. The amount of weight may effectively be reduced by use of props or supports on the deck or other structure supported by deck post 150.

The cavity 160 inside deck post 150 is, as discussed above, dimensioned to be slightly larger in diameter than extension rod 130. Thus, extension rod 130 is protected from weather and debris by both the body of deck post 150, as well as post nut 140 and post plate 145. Additional weather resistance may be provided by the selection of material for extension rod 130. For example, a grade 5 zinc-coated bolt has been shown to demonstrate suitable weather and rust-resistant qualities. With proper material, there may be no need for any cap or cover to be applied to extension rod 130, simplifying installation.

Footing 100 may be adjusted to level the deck or other structure support by deck post 150. Additionally, adjustments may be further made over the life of the structure to account for changes from settling over time, material warpage or shrinkage, and soil erosion, particularly in areas with high water tables.

As shown, both base nut 125 and post nut 140 are hexagonal nuts of similar dimension, which is considered aesthetically pleasing and permits the use of standard wrenches for assembly and adjustment. However, base nut 125 and post nut 140 need not be of similar dimension, nor of the same nut type, to enable adjustment. For example, base nut 125 may be a square nut, to enable greater leverage for rotation during adjustment. As another example, post nut 140 may be slightly rounded, to provide greater visual clarity that base nut 125 is meant to rotated to make height adjustments to footing 100.

According to an embodiment, for a standard 4×4 deck post, extension rod 130 is approximately 3 inches long and 1 inch in diameter, with cavity 155 being approximately 4 inches long and 1¼ inches in diameter. As an example, base plate 120 and post plate 145 may be 1⅜" washers having a 3¼" outside diameter. Thus, base nut 125 and post nut 140 may be 1" nuts which fit to the washers. Alternatively, as discussed above, base nut 125 and extension rod 130 may be combined using a 1" by 3" bolt. Other dimensions are possible depending on the size and materials of the deck post 150 and the adjustable footing 100.

According to a further embodiment, the deck post 150 is made of wood and the adjustable footing 100 is made of steel, with extension rod 130 zinc-coated for weather resistance (for example, a grade 5 zinc-coated bolt). Alternatively, deck post 150 may be made from a composite material, or concrete or steel.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description and all changes which come within the meaning and range of equivalency of the claims are therefore intended to be embraced therein.

What is claimed is:

1. An adjustable footing for a post, comprising:

a base, the base comprising a base plate, a fixed base nut secured to the base plate and a threaded rod secured to the base nut and extending perpendicular to the base without passing through the base plate, the base plate resting unsecured upon a support surface for the post and capable of rotation while resting on said support surface; and a top, the top comprising a post plate having a hole and a fixed post nut secured to the post plate over the hole external to the post and dimensioned to engage the threaded rod, wherein the post plate is secured to the post such that the threaded rod passes through the post nut and hole into a cavity in the post without engaging the post, and the overall height of the footing is adjustable by rotation of the base via the base nut without the need for any external support for the post; and wherein the base nut and post nut are of the same dimensions.

2. The footing of claim 1, wherein the threaded rod is further secured to the base plate.

3. The footing of claim 1, wherein the base plate and post plate are of the same dimensions.

4. The footing of claim 1, wherein the base plate, base nut, post plate and post nut are composed of the same materials.

5. The footing of claim 1, wherein the post plate is secured to the post by one or more screws.

6. A method of securing an adjustable footing to a deck post, comprising:

boring a cavity into a bottom surface of the deck post, the cavity extending along a longitudinal axis of the deck post;

securing a post plate to the bottom surface, the post plate having a hole aligned with the cavity and a post nut secured to the post plate external to the post and covering the hole; and connecting a base plate to the post plate by a threaded rod, the threaded rod extending perpendicular to the base plate without passing through the base plate and secured to the base plate by a fixed base nut, the base plate resting unsecured upon a support surface for the deck post and capable of rotation while resting on said support surface;

wherein the threaded rod extends into the cavity without engaging the post within the cavity;

wherein the base nut and post nut are of the same dimensions; and wherein the post plate, post nut, threaded rod, base nut and base plate form the adjustable footing for the deck post, with adjustment performed via rotation of the base plate.

7. The method of claim 6, wherein the height of the deck post is adjusted by rotation of the base nut without the need for any external support.

8. The method of claim 6, further comprising applying an anti-seize compound to the threaded rod prior to the connecting step.

9. The method of claim 6, wherein the post plate is secured by one or more screws.

10. The method of claim 6, wherein the base plate and post plate are of the same dimensions.

11. The method of claim 6, wherein the base plate, base nut, post plate and post nut are composed of the same materials.

* * * * *